US005329704A

United States Patent [19]

Martin, Jr.

[11] Patent Number: 5,329,704

[45] Date of Patent: Jul. 19, 1994

[54] SPLIT-SOLE ANTI-SLIP ATTACHMENTS FOR FOOTWEAR

[76] Inventor: Roy C. Martin, Jr., Rte. 1, Box 1882, Bangor, Me. 04401

[21] Appl. No.: 44,656

[22] Filed: Apr. 12, 1993

[51] Int. Cl.[5] ..... A43B 3/12; A43B 3/16

[52] U.S. Cl. ..... 36/7.1 R; 36/7.3; 36/7.6

[58] Field of Search ..... 36/7.1 R, 7.7, 7.5, 36/7.6, 7.8, 11.5, 87, 97, 9 A, 8.1, 8.2, 8.4

[56] References Cited

U.S. PATENT DOCUMENTS

| | | | |
|---|---|---|---|
| 278,337 | 5/1883 | Jones | 36/7.6 |
| 456,060 | 7/1891 | Reilly | 36/7.7 |
| 1,277,924 | 9/1918 | Heinzer | 36/7.6 |
| 2,002,706 | 5/1935 | Mong | 36/7.6 |
| 2,189,489 | 2/1940 | Fritz | 36/7.6 |
| 3,019,533 | 2/1962 | Smith | 36/7.6 |
| 3,672,078 | 6/1972 | Fukuoka | 36/11.5 |
| 3,718,993 | 3/1973 | Schovee | 36/7.3 |
| 4,302,890 | 12/1981 | Covell et al. | 36/7.6 |

FOREIGN PATENT DOCUMENTS

| | | | |
|---|---|---|---|
| 6661 | 6/1893 | Switzerland | 36/7.6 |
| 10210 | 4/1911 | United Kingdom | 36/11.5 |
| 2103069 | 2/1983 | United Kingdom | 36/7.1 R |

*Primary Examiner*—Steven N. Meyers

[57] ABSTRACT

A slip on attachment for use on footwear when additional traction is needed has a sole, a heel seat and resilient arms. The sole is divided by a slit opening through the toe portion and extending into the heel seat and is resiliently yieldable so that it will spread apart as footwear is inserted between and under the arms until the heel of the footwear can enter the heel seat, the arms then engaging and holding the footwear in its waist line zone. The sections of the sole are provided with anti-slip portions.

8 Claims, 2 Drawing Sheets

SPLIT-SOLE ANTI-SLIP ATTACHMENTS FOR FOOTWEAR

BACKGROUND OF THE INVENTION

While there are other surfaces than icy ones where better traction is desirable or needed for those traveling on foot over them, the present invention is disclosed herein with particular reference to icy conditions.

For many years, so called "ice creepers" have been available to enable ice to be walked on more safely. These, as far as I am aware have been and still are held on footwear by straps which, when buckled together, hold the ice creepers on the footwear. Such attachments, while generally satisfactory in use, require approximately the same procedures as is required to don conventional footwear. Such attachments, however, often are inconvenient to attach.

Footwear is, of course, available which is to be worn and provide improved traction on various surfaces. Shoes for golfers, track and field uses, and baseball and football players are examples which illustrate the different types of protuberances which are employed to provide adequate traction on different surfaces.

THE PRESENT INVENTION

The general objective of the present invention is to provide anti-slip attachments generally of the sandal type which can be quickly, conveniently and securely fixed on footwear while being worn and as easily and conveniently removed therefrom.

This objective is attained with anti-slip attachments shaped and dimensioned for use with conventional footwear within predetermined size hinges. Each such attachment has sole and upper structures with the former having a lengthwise division, typically a slit, extending from the toe area into the heel area to form resilient, spreadable sections. The upper structure has a counter and a pair of resilient arms, one at each side of the sole and both shaped and dimensioned to engage footwear in its waistline zone and sufficiently resiliently flexible to enable footwear to be entered between them then to be forced apart until the heel of the footwear can enter the seat established by the counter and the rear portion of the sole, the resilient arms then holding the attachment against the sole on movement forwardly relative thereto. The under surface of the sole has protrusions providing a wanted degree of traction.

The sole may be constructed to yieldably and resiliently hold the divided sections together. Such needed resiliency may also be provided by the counter or both the counter and the sole structure may serve to ensure that lateral separation of the divided portions is yieldable and resiliently opposed to an extent such that each attachment is securely held on footwear during use.

BRIEF DESCRIPTION OF THE DRAWINGS

The accompanying drawings illustrate a preferred embodiment of the invention

THE PREFERRED EMBODIMENT

The disclosed embodiment of the invention is one where the attachment is molded using a plastic such as polystyrene, which establishes a hard surfaced attachment possessed of a wanted degree of resilience.

Figure 1:
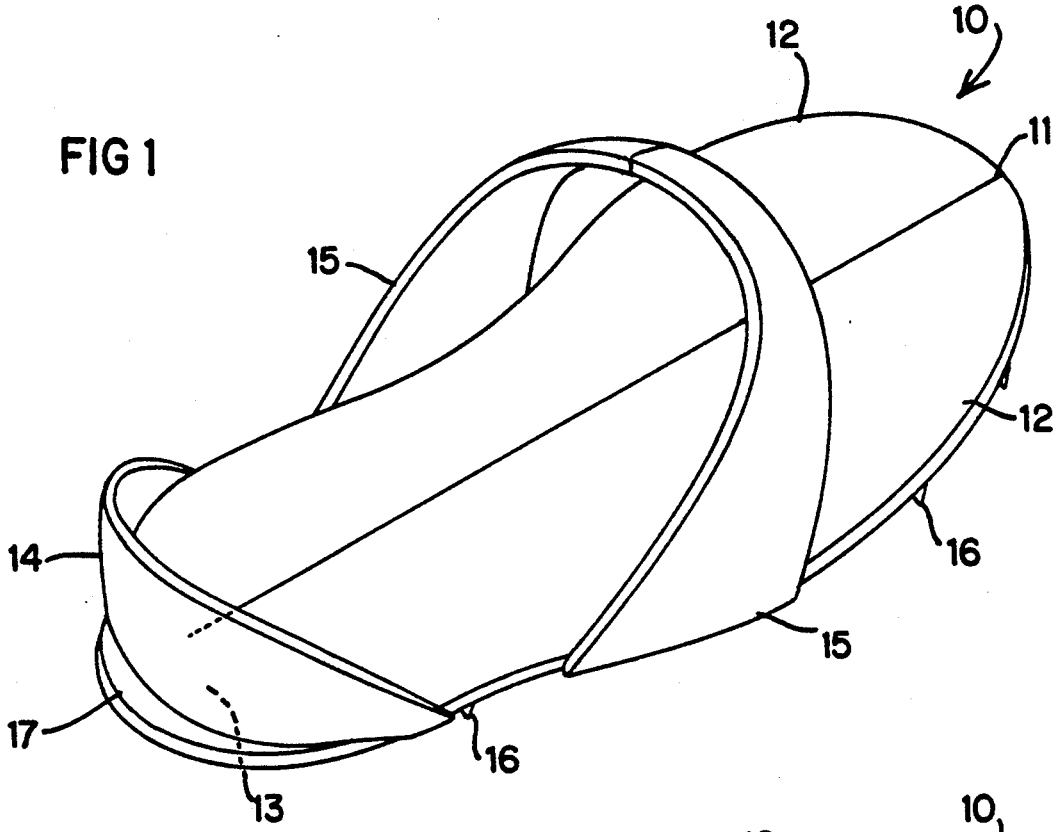
FIG. 1 is a perspective view of an attachment in accordance with the invention before use.
Figure 2:
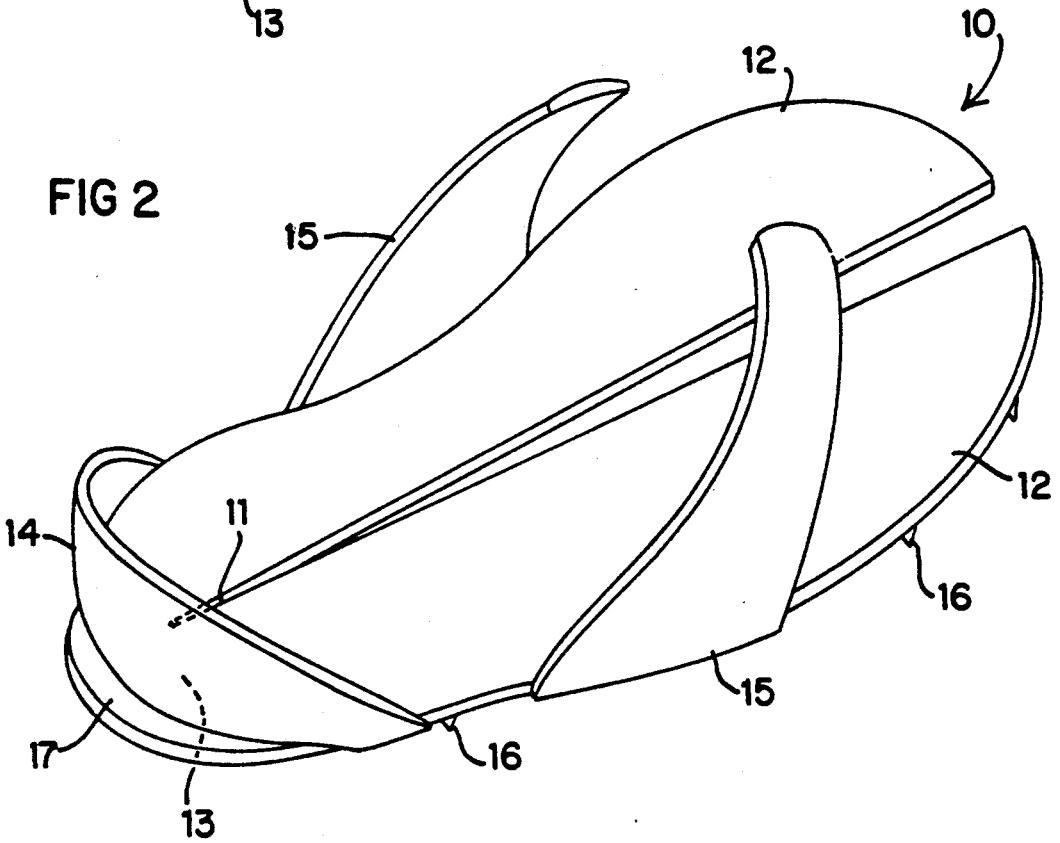
FIG. 2 is a like view with the sections of the divided sole spread apart and with the arms somewhat flexed as they would be in the course of footwear being slipped in place under them.
Figure 3:
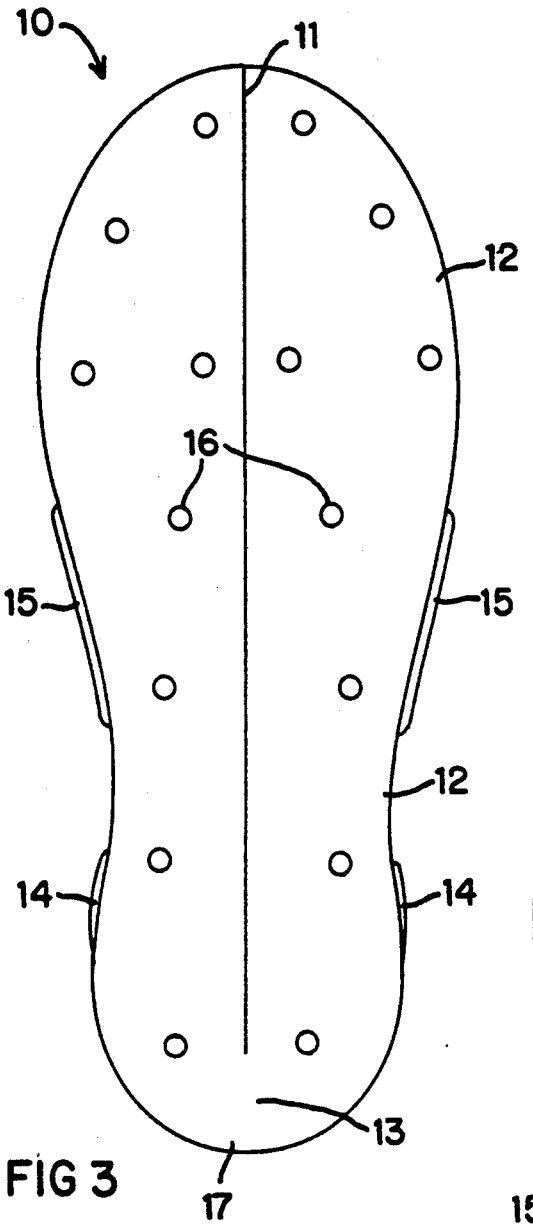
FIG. 3 is a plan view of the normal appearance of the tread surface of the attachment.
Figure 4:
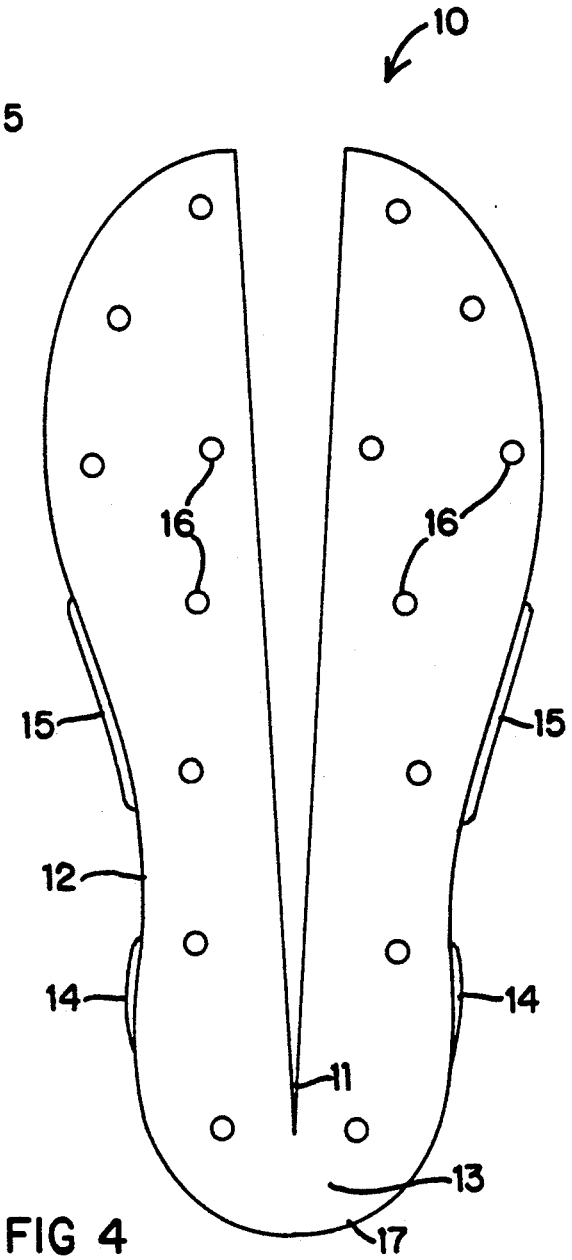
FIG. 4 is a like view of the tread surface with the sections of its sole spread apart.

The thus formed attachment has a sole generally indicated at 10 and having a central slit 11 extending rearwardly from the toe end into the heel portion to form like sections 12 but leaving a connecting portion 13 at the rear or heel end of the sole. The attachment includes a counter 14, either molded with or bonded to the heel portion of the sole 10. The attachment also is provided with a pair of arms 15, one for each side margin of the sole and either molded or bonded thereto. The arms 15 are shaped and disposed to resiliently engage footwear along substantial portions of its waistline zone and the arms are shown in FIG. 1 with their free ends abutting. Each attachment can be fitted on the footwear on either foot.

When it is desired to use the attachment, the toe of an article of footwear is introduced under the arms 15 and, on relative movement between the footwear and the attachment, the arms 15 are forced apart with the attendant spreading of the two sections 12 of the sole 10. Such spreading continues until the arms 15 embrace the waistline of the footwear and the heel of the footwear can enter the seat established by the counter 14 and the portions of the sole partially surrounded thereby.

The under surfaces of the sole are shown as provided with spike-like protuberances 16 and these may be formed when the sole is molded or metal spikes may be molded in the sole or attached afterwards.

The removal of the attachment is easily effected as by dislodging its heel seat from the footwear. For that purpose, the sole 10 extends rearwardly of the counter 14 to provide a substantial shoulder 17 engageable by the toe of the footwear being worn or an attachment secured thereto. With the rear portion of the attachment released and held, the footwear may be slid rearwardly until the arms 15 are spread apart to release it.

It will be apparent from the foregoing that attachments in accordance with the invention are well adapted to meet manufacturing requirements as well as those of use.

I claim:

1. In combination, an article of footwear and an attachment therefor, said article having sole structure and upper structure secured thereto, the upper structure having a waist line dividing the article into fore and rear parts, the rear part provided with a heel portion and the fore part having a toe portion, and said attachment including a flexible, resilient sole and upper structure connected thereto, the upper structure of the attachment including a resilient counter yieldably maintained in a first position against spreading and defining a heel seat with the portion of the sole which is bordered thereby, the heel seat of lesser width than the heel portion of the article, the upper structure also including resilient, waist line arms, one for each side of the sole and curved inwardly and forwardly towards the opposite side, the two arms spaced and dimensioned to enable the toe portion of the article to be entered between the two arms and the sole of the attachment including two lengthwise sections joined together in the heel seat, the maximum width of the sole less than the widest portion of the forepart of the article whereby when the article is slid forwardly relative to the attachment, the two sections and the heel seat are spread apart with the arms as the forepart of the article is forged between and forwardly of the arms, the resiliency of the heel seat then forcing the heel seat and the arms into holding contact with the heel portion and waist line of the upper structure of the article, respectively, and the tread surfaces of said sole sections provided with traction enhancing members.

2. The combination of claim 1 in which the sole has a line of severance extending through the toe and into the heel seat and establishing the spreadable sections.

3. The combination of claim 1 in which the line of severance terminates short of the extremity of the heel portion and provides a resilient web.

4. The combination of claim 1 in which the counter functions as a U-shaped spring.

5. The combination of claim 1 which the sole and upper structure are molded together as a unit.

6. The combination of claim 1 in which the sole thereof extends rearwardly of the heel seat to establish a lip engageable in attachment removal by the toe of a worn article of footwear or the toe of an attachment being worn.

7. The combination of claim 1 in which the cross sectional dimensions of each arm are maximum adjacent the sole and minimum adjacent the free end thereof thereby to be relatively inflexible adjacent the sole and the free end thereof sufficiently flexible to yield to enable the forepart of the article to pass between the two arms.

8. The combination of claim 1 in which the arms are of a length such that the free ends thereof are substantially in abutment when the attachment is detached from the article of footwear.

* * * * *